United States Patent [19]

Sato

[11] 4,068,584

[45] Jan. 17, 1978

[54] CARTRIDGE-TYPE INK SUPPLY DEVICE FOR LABELING MACHINES

[75] Inventor: Yo Sato, Tokyo, Japan

[73] Assignee: Kabushiki Kaisha Sato Kenkyusho, Japan

[21] Appl. No.: 793,371

[22] Filed: May 3, 1977

Related U.S. Application Data

[62] Division of Ser. No. 663,693, March 4, 1976.

[30] Foreign Application Priority Data

Mar. 6, 1975 Japan ..... 50-26525

[51] Int. Cl.[2] ..... B41F 1/46

[52] U.S. Cl. ..... 101/103; 101/288; 101/324; 101/359; 156/384

[58] Field of Search ..... 101/97–99, 101/95, 101, 82, 83, 202, 205, 193, 335, 338, 348, 288, 292, 293, 295, 327, 333, 334, 324, 325, 326, 103–105, 106, 108, 206–209, 328–331, 291, 305, 314; 156/384, 385, 386, 387, 388

[56] References Cited

U.S. PATENT DOCUMENTS

| | | | |
|---|---|---|---|
| 770,956 | 9/1904 | Bradley | 101/106 |
| 1,157,698 | 10/1915 | Kern | 101/83 |
| 1,525,659 | 2/1925 | Rumpf | 101/103 |
| 2,756,674 | 7/1956 | Rieger et al. | 101/333 X |
| 2,819,668 | 1/1958 | McAney | 101/125 |
| 2,899,895 | 8/1959 | Tannery | 101/381 |
| 3,227,082 | 1/1966 | Lynch | 101/405 |
| 3,326,124 | 6/1967 | Heil et al. | 101/348 X |
| 3,376,813 | 4/1968 | Heil et al. | 101/348 |
| 3,388,662 | 6/1968 | Raureby | 101/405 |
| 3,551,251 | 12/1970 | Sato et al. | 156/384 |
| 3,798,106 | 3/1974 | Jenkins et al. | 101/405 |

*Primary Examiner*—J. Reed Fisher

*Attorney, Agent, or Firm*—Haseltine, Lake & Waters

[57] ABSTRACT

The disclosure relates to a cartridge type supply device for use with a portable, one-hand-operable labeling machine of the type including a printing mechanism with printing types arranged for imprinting inscriptions on each of a series of labels traveling along a predetermined path through the machine toward a dispensing opening of the machine. The ink supply device comprises a cartridge holder pivotally supported at one end thereof within the labeling machine in a readily detachable manner and a replaceable inking roller cartridge supported detachably by the other end of said cartridge holder said cartridge including a rotatable inking roller. The cartridge holder is spring-biased to urge the inking roller onto surfaces of the printing types of the printing mechanism of the labeling machine. When the inking roller cartridge is used up, the cartridge holder can be taken out of the machine together with the used cartridge. A cartridge box for housing spare inking roller cartridges is provided.

5 Claims, 33 Drawing Figures

CARTRIDGE-TYPE INK SUPPLY DEVICE FOR LABELING MACHINES

CROSS-REFERENCE TO RELATED APPLICATIONS

The present application is a division of the co-pending application Ser. No. 663,693, filed Mar. 4, 1976.

BACKGROUND OF THE INVENTION

The present invention relates to improvements in or relating to the ink supply device for use in portable labeling machines of the type disclosed, for example, in U.S. Pat. Re. No. 27,889. More specifically, the invention deals with a device utilizing cartridges for supplying ink to the printing mechanism of a labeling machine.

The printing mechanism of the labeling machine under consideration is used for printing inscriptions on each of a series of labels fed by indexed movement along a travel path thereof within the machine. Upon manual actuation of the machine, the printing types of the printing mechanism is brought in the position faced on successive blank labels and pressed onto each of said labels. The printing types is customarily inked by a roller which is made of spongy material impregnated with ink and which is usually spring-actuated into circumferential contact with the drum.

Upon exhaustion of the ink impregnated in the inking roller, a suitable squirt has heretofore been employed to manually re-impregnate the roller in situ with a fresh supply of ink. In this manner, however, the ink tends to permeate unevenly through the roller, with the result that the printed characters on the labels are of inconsistent ink density and are sometimes undecipherable. Moreover, the ink squirted inadvertently or in an excess amount is liable to smear the machine, the articles to be labeled, and the operator's hands and clothes.

In another known method, the exhausted inking roller is replaced by a new, identical roller. The ink supply device constructed according to this method requires the direct handling of the rollers for their replacement, so that the operator's hands and clothes are also likely to be smeared. Other additional difficulties involved in the prior ink supply devices are that the inking roller cannot be readily and securely mounted on and dismounted from the roller holder and that the inking roller holder itself cannot be readily and securely attached to or detached from the labeling machine.

It has also been proposed to replace the exhausted inking roller together with its holder by a new roller combined with its own holder. This scheme is not sufficiently practical in view of the high expenses involved.

The labeling machine in question is perhaps best adapted for affixation of price tags to merchandise in stores, supermarkets and like commercial establishments. As will be surmised from the above noted state of the art, one often finds tags that are illegible, due obviously to the improper supply of ink to the printing mechanism of the machine. Recently, in large supermarkets and the like, there is a growing trend to employ automatic optical readers to sense the data printed on the price tags. This is all the more reason why the tags are required to bear even more clear-cut inscriptions than heretofore.

SUMMARY OF THE INVENTION

It is, therefore, among the objects of the present invention, to provide an improved ink supply device for the printing mechanism of a labeling machine, said device causing an advantage such that the listed inconveniences of the prior arts are overcome in a simple and thoroughly practicable manner.

Another object of the invention is to provide an ink supply device employing inking rollers in the form of readily replaceable cartridges so that inscriptions of sharp, clear outline can always be imprinted on the labels.

A further object of the invention is to provide an ink supply device which permits replacement of the inking rollers without any possibility of smearing the operator's hands and clothes and other objects.

A still further object of the invention is to provide an ink supply device well adapted for combined use with a cartridge box conveniently housing a plurality of spare inking roller cartridges for ready replacement of the cartridge in use.

A further important object of the invention is to provide an ink supply device well adapted for the labeling machine in which plural typing means are provided in the traveling direction of the inking roller, said ink supply device being able to carry out stable ink supply onto the types of all typing means by using only one inking roller assembly and being adapted for insuring detachable attachment of the inking roller cartridge to the cartridge holder and attachment of said holder to the labeling machine and that.

With these objects in view and the other objects hereinafter set forth, the invention provides an ink supply device for use in a labeling machine comprising a printing mechanism. The ink supply device comprises essentially a cartridge holder which is detachably attached at one end thereof to the labeling machine at a position adjacent the printing mechanism of the machine, and a replaceable inking roller cartridge which is detachably mounted on a cartridge seating provided on the other end of said cartridge holder. The cartridge holder is spring-biased to urge the inking roller of the inking roller cartridge onto surface of types of the printing mechanism.

Thus, when the inking roller is exhausted, the cartridge holder may be taken out of the machine together with the used cartridge. Since the inking roller cartridge is typically attached to the cartridge holder in a mortise-and-tension-joint fashion, the used cartridge is readily replaceable with any of several spare cartridges housed in a cartridge box. Throughout the complete procedure of cartridge replacement, the operator is required to grasp the cartridge holder only, and therefore there is no need for him to directly handle the inking rollers or the inking roller cartridges.

The features which are believed to be novel and characteristic of the invention are set forth in particular in the claims appended hereto. The invention itself, however, both as to its organization and mode of operation, together with the further objects and advantages thereof, will become apparent in the course of the following description when read in conjunction with the accompanying drawings which illustrate some preferred embodiments of the invention and in which like reference characters denote corresponding parts of the several views.

DETAILED DESCRIPTION OF THE INVENTION

Figure 1:
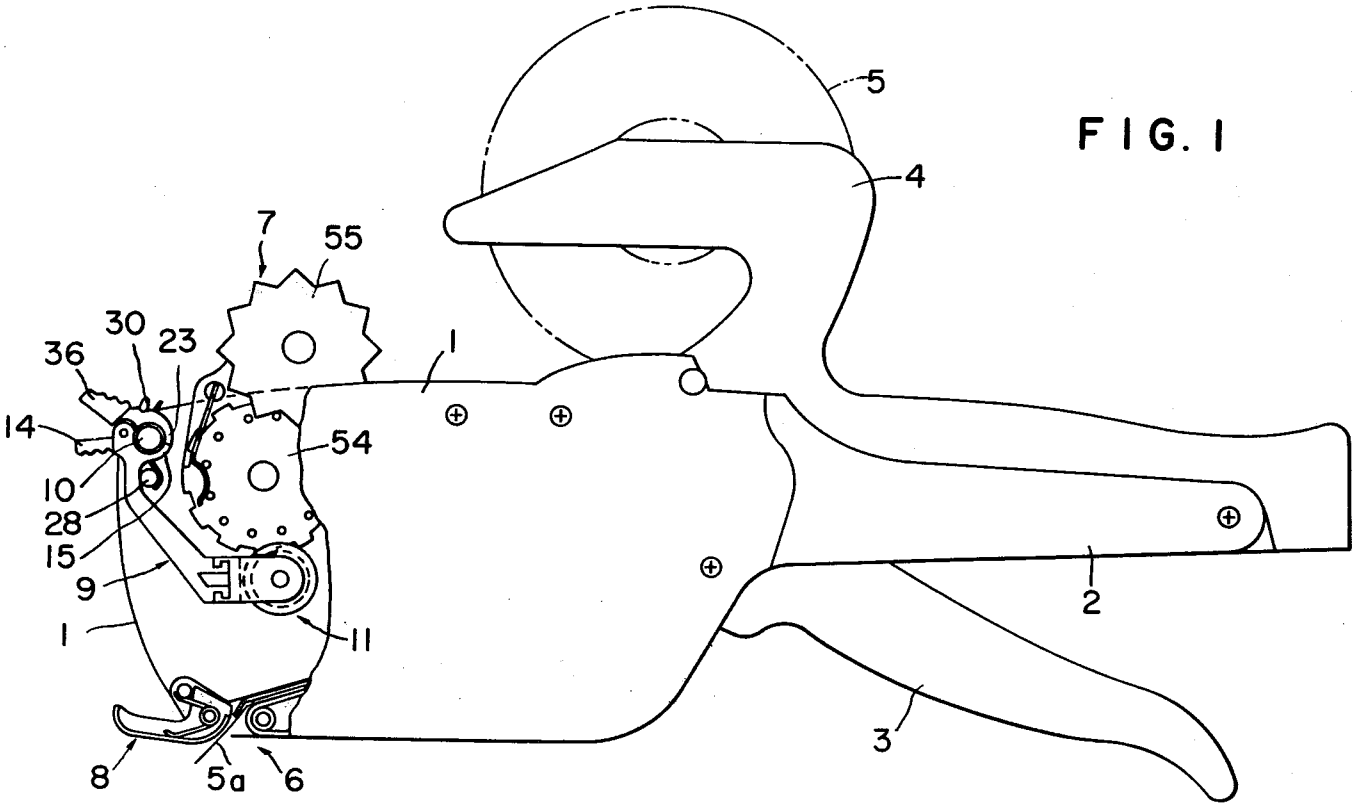
FIG. 1 is a side elevational view of a labeling machine of the type including a rotatable printing drum having selectable relief characters on its cylindrical surface, in which one of the side walls of the machine is shown partly broken away to clearly reveal an ink supply device according to the invention and attached to said machine.

FIGS. 1 to 15, inclusive, are directed to the illustration of the first preferred embodiment of the invention. With particular reference to FIG. 1, the illustrated labeling machine has a frame including a pair of side walls 1 rigidly connected to each other in spaced parallel relationship. A palm-grip handle 2 integrally extends rearwardly (i.e., toward the right as viewed in FIG. 1) of the side walls 1. A grip lever 3 is pivotally supported under the palm-grip handle 2 so as to manually turned toward and away from the latter.

Figure 2:
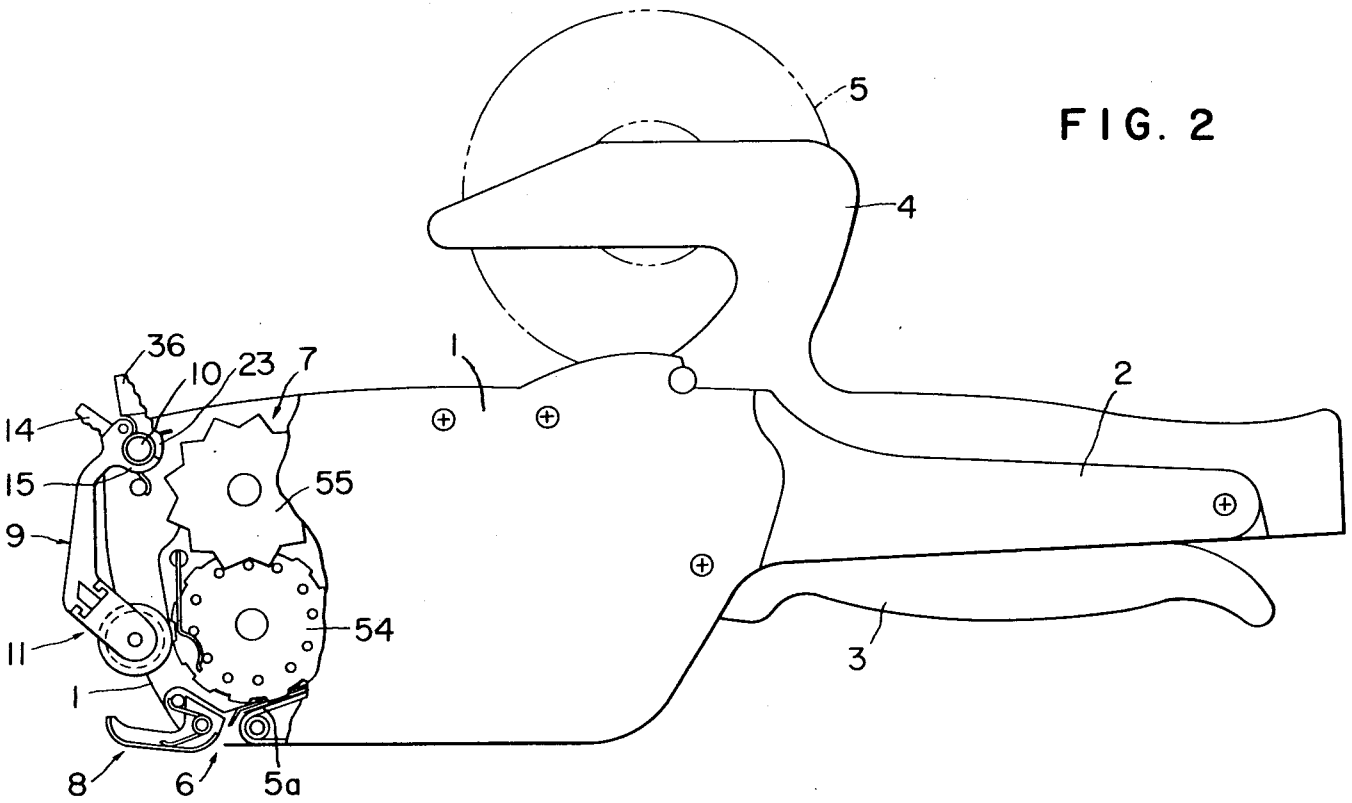
FIG. 2 is a similar view showing the labeling machine shown in FIG. 1, but in actuated state.

Over the machine frame there is mounted a roll holder 4 rotatably supporting a roll of label tape 5 coated on one surface with a suitable adhesive and adapted to be severable into individual labels of a specific size. Each time the grip lever 3 is turned toward the palm-grip handle 2 against the bias of a return spring (not shown) by manual squeezing operation, as illustrated in FIG. 2, the label tape unwound from the roll of label tape 5 is fed a constant distance along a predetermined path within the machine frame toward its dispensing opening shown at 6.

Arranged along the path of travel of the label tape within the machine frame is a tape advancing mechanism (not shown) driven by operation of the grip lever 3 to advance and guide the label tape with indexed movement along the path; a tape cutting mechanism (not shown) also driven by movements of the grip lever to sever the label tape into individual labels; a printing mechanism 7 also driven by movements of the grip lever to imprint desired inscriptions on the labels; and a label applying mechanism 8 positioned adjacent the dispensing opening 6 and operating to press each printed label against an article and thereby to cause the adhesive to stick the label to the article.

The portable, one-hand-operable labeling machine of the above outlined general character is shown and described in the aforementioned U.S. Pat. Re. No. 27,889. This invention is directed to improvements in or relating to the printing mechanism 7 itself in the labeling machine of the above character.

Figure 3:
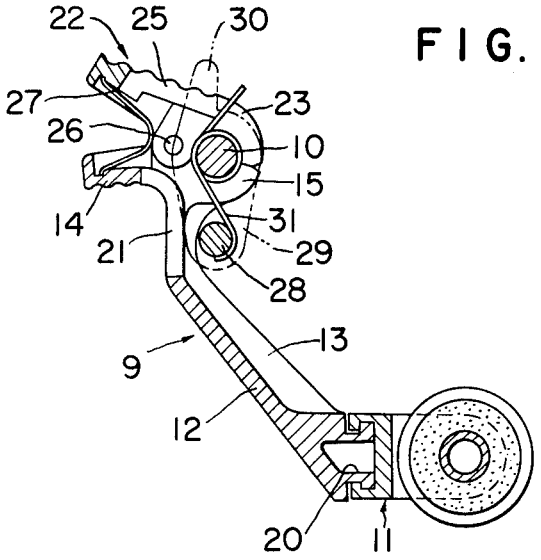
FIG. 3 is a longitudinal sectional view of the ink supply device used in the machine shown in FIGS. 1 and 2 comprising a cartridge holder with an inking roller cartridge detachably mounted thereon.

More specifically, the invention provides a cartridge-type ink supply device to be incorporated in the printing mechanism 7 of the labeling machine, the preferable form of said device being best illustrated in FIG. 3. The illustrated ink supply devices comprises essentially a cartridge holder 9 detachably pivoted on a transverse pin 10 extending between the opposed side walls 1 of the machine frame, as will be seen by referring back to FIGS. 1 and 2, and a replaceable inking roller cartridge 11 which is also detachably mounted on the free end of the cartridge holder 9. The cartridge holder 9 and the inking roller cartridge 11 are respectively illustrated in greater details in FIGS. 4 through 9 and in FIGS. 10, 11, and 12.

Figure 4:
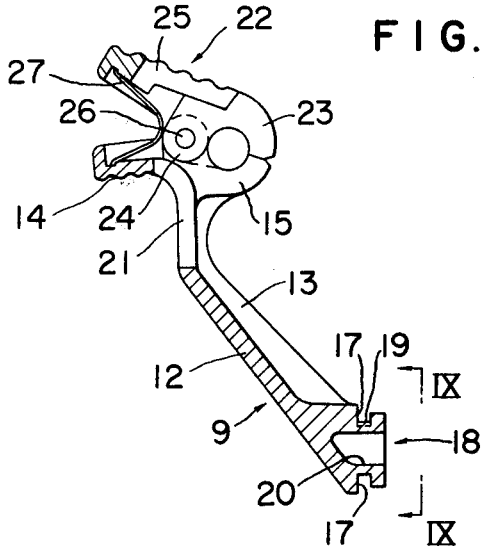
FIG. 4 is a similar view of the cartridge holder shown in FIG. 3, but the inking roller cartridge is taken out therefrom.
Figure 5:
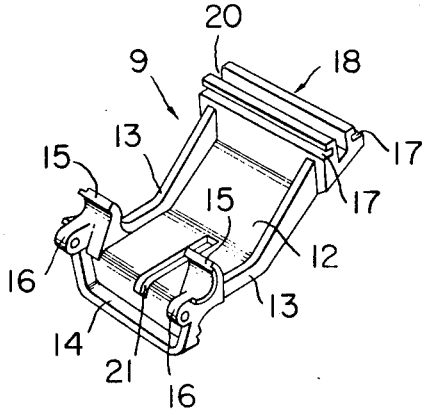
FIG. 5 is a perspective view of the cartridge holder shown in FIG. 4 and from which a second finger-hold tab is removed.

As will be seen from FIGS. 4 and 5 in particular, the cartridge holder 9 includes a slightly bent, generally rectangular portion 12 having a pair of upturned flanges 13 along both lateral edges and terminating at its upper end in a first fingerhold tab 14 angled away from that side of the portion 12 on which the flanges 13 are formed. The first fingerhold tab 14 is associated with one or more (two in the illustrated example) first gripping jaws 15 which substantially extend from the tab toward the flanged side of the portion 12 in transverse alignment with each other. A pair of centrally apertured ears 16 are formed between the first fingerhold tab 14 and the respective first gripping jaws 15.

The lower or free end of the cartridge holder 9 is suitably thickened to provide a seating on which the inking roller cartridge 11 is to be detachably mounted, as will be later described in more detail. The cartridge seating has a pair of oppositely opening grooves 17 which are intended to shape the thickened lower end of the cartridge holder into a tenon 18 of substantially T-shaped cross section extending the full transverse length of the cartridge holder. One of the grooves 17 has a small semicircular projection 19 provided therein, as shown particularly in FIGS. 4 and 9. Preferably, a relatively deep, wide groove 20 should be formed to longitudinally divide the tenon 18 into two spaced apart parts. The cartridge holder 9 further includes a longitidinal slot 21 formed centrally in the rectangular portion 12 adjacent the upper end thereof.

Figure 6:
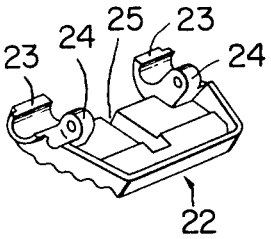
FIG. 6 is a perspective view of the second finger-hold tab of the cartridge holder shown in FIG. 4.

The reference numeral 22 denotes a second fingerhold tab which cooperates with the first fingerhold tab 14 to detachably mount the cartridge holder 9, and hence the inking roller cartridge 11, in position on the labeling machine. As best illustrated in FIG. 6, the second fingerhold tab 22 is integrally provided with a pair of transversely aligned second gripping jaws 23 adapted to coast with the respective first gripping jaws 15 for relatively loose gripping or clamping engagement of the transverse pin 10 extending between the opposed side walls 1 of the machine frame. A pair of centrally apertured ears 24 are formed between the second fingerhold tab 22 and the respective second gripping jaws 23. The second fingerhold tab 22 has a slot 25 formed centrally therein so as to be disposed in vertical register with the slot 21 in the rectangular portion 12 of the cartridge holder 9 when the second fingerhold tab 22 is mounted in position on the latter as shown in FIGS. 3 and 4.

The second fingerhold tab 22 with its gripping jaws 23 is adapted to be pivotally mounted over the first fingerhold tab 14 by a pivot pin 26 inserted into and through the transversely aligned apertures in the ears 16 and 24. Installed between the first and second fingerhold tabs 14 and 22 is a leaf spring 27, FIG. 8, which biases the first and second gripping jaws 15 and 23 toward each other. Thus, for mounting the cartridge holder 9 with its inking roller cartridge 11 in position on the labeling machine shown in FIGS. 1 and 2, a compressing pressure should be applied to the first and second tabs 14 and 22 by the fingers against the pins of the leaf spring 27 thereby causing the first and second gripping jaws 15 and 23 to turn relatively away from each other about the pivot pin 26. The tabs 14 and 22 may be released while the transverse pin 10 between the opposed side walls 1 of the machine frame is held between the gripping jaws 15 and 23, with the result that the pin is positively but rotatably clamped or gripped by the jaws.

While the second fingerhold tab 22 is shown to be an independent part in FIG. 6, it will be appreciated from the foregoing description that this tab constitutes an essentially integral part of the cartridge holder 9.

Figure 7:
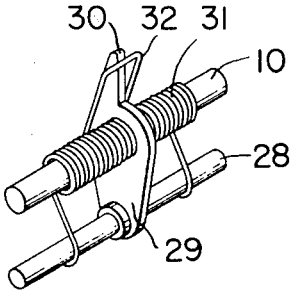
FIG. 7 is a perspective view showing means on which the cartridge holder shown in FIG. 3 is to be mounted.
Figure 8:
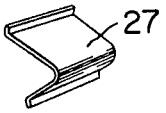
FIG. 8 is a perspective view of a leaf spring used in the cartridge holder shown in FIG. 3.
Figure 9:
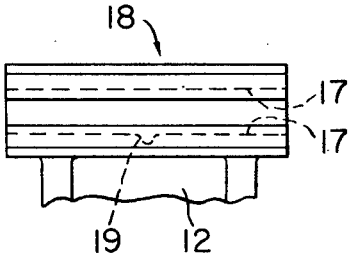
FIG. 9 is a fragmentary end elevational view of the cartridge holder as seen in the direction of the arrows IX—IX in FIG. 4.

With particular reference to FIG. 7, a second transverse pin 28 is supported by the opposed side walls 1 of the machine frame substantially in vertical register with the first mentioned transverse pin 10. A stationary member 29 having an upwardly projecting tongue 30 is mounted vertically on the first and second pins 10 and 28. A torsion spring 31 coiled around the first transverse pin 10 has both of its terminal hooks extending downwardly to engage the second transverse pin 28, and the mid-portion 32 of the torsion spring is deformed into the shape of an inverted U and extends upwardly to be urged against the tongue 30 of the stationary member 29.

When the cartridge holder 9 is mounted in position by clamping the first transverse pin 10 between the gripping jaws 15 and 23 as above explained, the stationary member 29 is partly received with clearance in the slots 21 and 25 of the cartridge holder, with the tongue 30 projecting upwardly through the slot 25, as best illustrated in FIG. 3. At this juncture, the inverted U-shaped mid-portion 32 of the torsion spring 31 becomes pressed clockwise, as viewed in FIG. 3, by the second fingerhold tab 22, so that the entire cartridge holder 9 as well as the inking roller cartridge 11 is yieldably urged to turn counterclockwise about the first transverse pin 10. It will be seen that the second transverse pin 28 functions as a stop limiting the counterclockwise motion of the cartridge holder 9.

Figure 10:
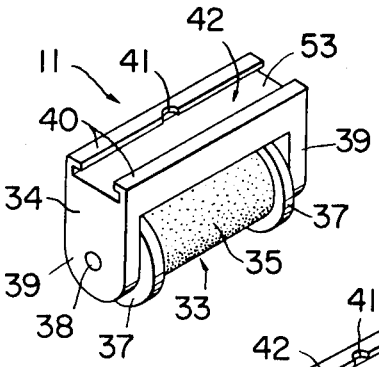
FIG. 10 is a perspective view of the inking roller cartrdige shown in FIG. 3.
Figure 11:
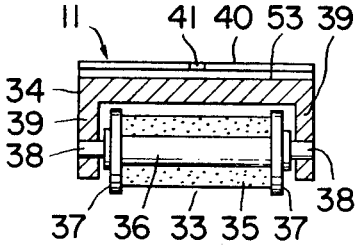
FIG. 11 is a longitudinal axial sectional view of the inking roller cartridge shown in FIG. 10.
Figure 12:
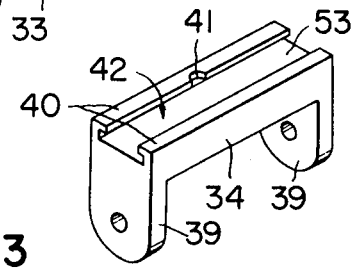
FIG. 12 is a perspective view of the roller support of the cartridge shown in FIGS. 10 and 11.

Referring to FIGS. 10 to 12, inclusive, the inking roller cartridge 11 comprises essentially an inking roller assembly 33 and a U-shaped roller support 34. The inking roller assembly 33 includes an inking roller 35 of spongy or like material uniformly impregnated with suitable amount of ink and fixedly mounted on a rod-shaped core 36 between a pair of flanges 37. A pair of trunnions 38 projecting axially outwardly of the respective flanges 37 are rotatably journaled in the respective side plates 39 of the roller support 34, so that the inking roller assembly 33 as a whole is rotatable relative to the roller support 34.

As best illustrated in FIGS. 10 and 12, the U-shaped roller support 34 has a pair of inwardly flanged rims 40 formed along the respective lateral edges of its top surface. One of the flanged rims 40 has a small semicircular indentation 41 located centrally therein. It will be seen that the flanged rims 40 are adapted to define a mortise 42 capable of slidably receiving the tenon 18 on the free end of the cartridge holder 9.

Thus, as will be seen by referring also to FIG. 3, the inking roller cartridge 11 can be readily mounted on the cartridge holder 9 as the tenon 18 of the latter is slid into the mortise 42 of the former. It should be noted that the inking roller cartridge 11 can be securely held in the correctly aligned position on the cartridge holder 9 because the indentation 41 in one of the flanged rims 40 of the roller support 34 releasably engages the projection 19 formed correspondingly in one of the grooves 17 of the cartridge holder.

The cartridge holder 9 and the inking roller cartridge 11 can mostly be conveniently molded of plastic material.

Figure 13:
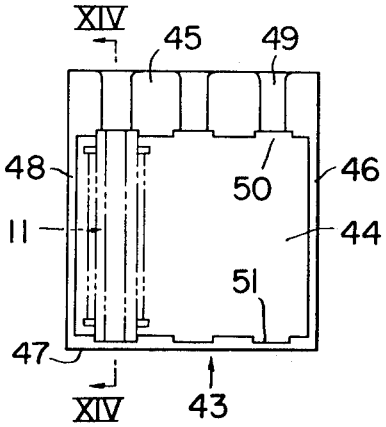
FIG. 13 is a top plan view of a cartridge box for use with the inking roller cartridge shown in FIGS. 10 through 12, inclusive.
Figure 14:
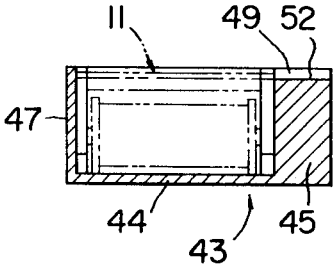
FIG. 14 is a sectional view of the cartridge box taken along the plane of line XIV—XIV in FIG. 13.
Figure 15:
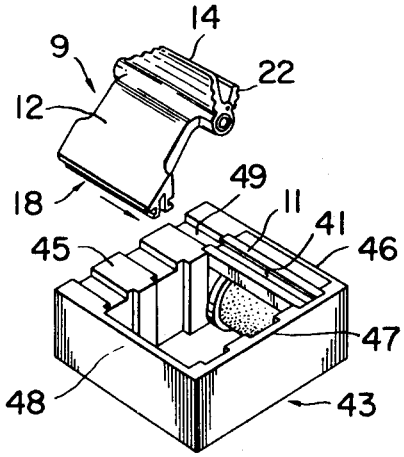
FIG. 15 is a perspective view of the cartridge box shown in FIGS. 13 and 14 and is explanatory of the manner in which the inking roller cartridge housed in the cartridge box is mounted on the cartridge holder shown in FIG. 4.

FIGS. 13, 14, and 15 illustrate a cartridge box 43 well adapted for combined use with the ink supply device according to the invention. The cartridge box 43 houses a plurality (three according to the illustrated example) of inking roller cartridges 11 of identical make. The cartridge box comprises a bottom wall 44 and side walls 45, 46, 47 and 48, being open at the top. The side wall 45 is significantly thicker than the other side walls 46 to 48 or the bottom wall 44, and a plurality of guide channels 49 are formed transversely in the top surface of the side wall 45 in parallel spaced relationship. The internal surface of the side wall 45 and the opposed internal surface of the side wall 47 are correspondingly recessed at 50 and 51, respectively, to neatly accommodate the U-shaped roller supports 34 of the respective inking roller cartridges 11. The cartridges are thus housed in the cartridge box 43 in close side-by-side arrangement, with their inking roller assemblies 33 disposed downwardly.

It will be noted that the aforesaid guide channels 49 in the top surface of the side wall 45 are arranged in alignment with the respective cartridges housed in the cartridge box 43. Moreover, the bottom surfaces 52 of these guides channels must be flush with the top surfaces 53, FIGS. 10 to 12, of the roller support 34 of the cartridges when the latter are properly mounted within the cartridge box, for reasons hereinafter set forth.

For mounting one of the inking roller cartridges 11 housed in the cartridge box 43 on the cartridge holder 9, the tenon 18 of the latter may be slid into the mortise 42 in one of the cartridges via the adjacent guide channel 49, as illustrated in FIG. 15. The sliding motion of the tenon 18 into the mortise 42 will be arrested as the leading end of the former abuts against the cartridge box side wall 47, when the projection 19 in one of the grooves 17 of the cartridge holder releasably engages in the indentation 41 in the corresponding flanged rim 40 of the cartridge. The cartridge holder 9 with the attached inking roller cartridge 11 may now be pulled upwardly away from the cartridge box 43. The inking roller cartridge can then be easily removed from within the cartridge box without suffering any lateral displacement relative to the cartridge holder.

With reference again to FIG. 1, the printing mechanism 7 of the illustrated labeling machine includes a printing drum 54 comprising a plurality of type discs arranged in coaxial, side-by-side relationship. Each type disc has a plurality of relief characters formed on its circumference at constant spacings. Above the printing drum 54 there may be provided a plurality of toothed wheels 55 arranged coaxially in driving relationship to the respective type discs of the printing drum. Thus, by selectively manually rotating the toothed wheels 55, the angular positions of the respective type discs can be changed as desired, so that any selected ones of the relief characters on the respective type discs can be brought to predetermined printing positions which are transversely aligned on the underside of the printing drum 54.

When the cartridge holder 9 with the inking roller cartridge 11 attached thereto as above described is pivotally mounted in position on the illustrated labeling machine by clamping the first transverse pin 10 between the gripping jaws 15 and 23, the inking roller 35 of the cartridge is yieldably urged by the torsion spring 31, FIG. 7, into circumferential contact with the printing drum 54 thereby inking the relief characters that are arranged in the aforesaid printing positions on the underside of the drum.

For printing one of the labels shown at **5*a* in FIGS. 1 and 2, the palm-grip handle 2 and the grip lever 3 may be grasped in one hand, and the latter may be turned toward the former against the bias of the unshown return spring, as illustrated in FIG. 2. Thereupon the printing drum 54 as well as the toothed wheels 55 descends onto one of the labels 5*a* to leave thereon the clear-cut impressions of the relief characters that are located in the printing positions on the drum. The descending printing drum 54 shoves aside, in effect, the inking roller 35, causing the cartridge holder 9 together with the cartridge 11 to turn clockwise, as viewed in FIGS. 1 and 2, about the first transverse pin 10 against the influence of the torsion spring 31. As the grip lever 3 is succeedingly released, the printing drum 54 and the toothed wheels 55 return from their positions shown in FIG. 2 to those shown in FIG. 1, so that the cartridge holder 9 together with the inking roller cartridge 11 also return to the position shown in FIG. 1 thereby to cause the inking roller 35** to ink the printing drum again.

When the supply of ink that has impregnated the inking roller 35 is used up by the repetition of the above described procedure, the first and second finger-hold tabs 14 and 22 is held by the fingers and turned toward each other to cause the gripping jaws 15 and 23 to release the first transverse pin 10 between the opposed side walls 1 of the machine frame. The used inking roller cartridge 11, upon withdrawal from within the machine together with the cartridge holder 9, is brought back into the cartridge box 43 by sliding the U-shaped roller support 34 down into the latter along one of the opposed pairs of recesses 50 and 51. The cartridge holder 9 is easily removable from the used inking roller cartridge 11 as the former is succeedingly pulled away from the cartridge box 43 via the adjacent guide channel 49.

The cartridge holder 9 is then slid back into the cartridge box 43 via some other guide channel 49 to guide its tenon 18 into the mortise 42 of a fresh inking roller cartridge. Thereafter, the cartridge holder with the fresh inking roller cartridge can be mounted in position on the labeling machine through exactly the same procedure as that previously set forth.

Figure 16:
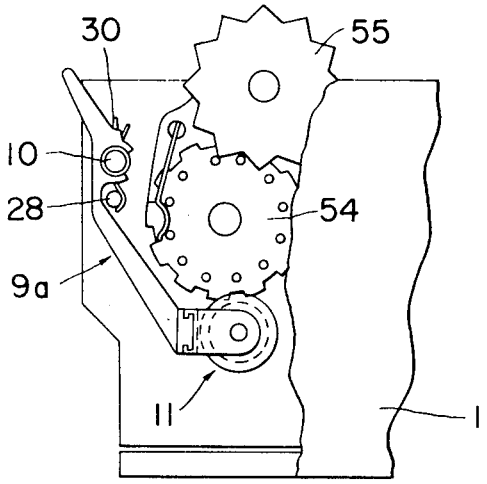
FIG. 16 is a fragmentary, partly broken-away, side elevational view of the labeling machine to which an ink supply device constituting another preferred embodiment of the invention is attached.
Figure 17:
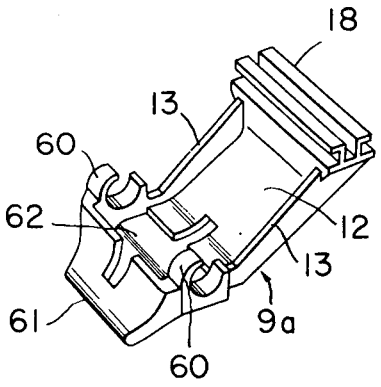
FIG. 17 is a detailed perspective view of the cartridge holder shown in FIG. 16.

FIGS. 16 and 17 illustrate a modification of the cartridge holder 9. The modified cartridge holder **9*a*, which also can be molded of plastic material, integrally comprises one or more (two in the illustrated example) pairs of gripping jaws 60 adapted for relatively loose gripping or clamping engagement of the first transverse pin 10 between the opposed side walls 1 of the machine frame and a fingerhold tab 61 to be held by the fingers in manipulating the gripping jaws into and out of engagement with the first transverse pin. A window 62 may be formed between the pairs of gripping jaws 60**.

By virtue of the inherent resiliency of the plastic material in use, each pair of the gripping jaws 60 are yieldable away from each other when being manipulated into and out of gripping engagement with the first transverse pin 10, so that the cartridge holder 9*a* can be readily mounted on, and dismounted from, the pin. Other details of construction concerning the modified cartridge holder 9*a* are substantially the same as those described earlier in connection with FIGS. 3, 4, 5, 7 and 9. It will also be apparent that the cartridge holder 9*a* is well adapted for combined use with the inking roller cartridge 11 shown in FIGS. 10, 11, and 12, and that the cartridge holder 9*a* with the inking roller cartridge 11 mounted thereon functions in exactly the same manner as that above stated in conjunction with the preceding example with reference to FIGS. 1 and 2.

Figure 18:
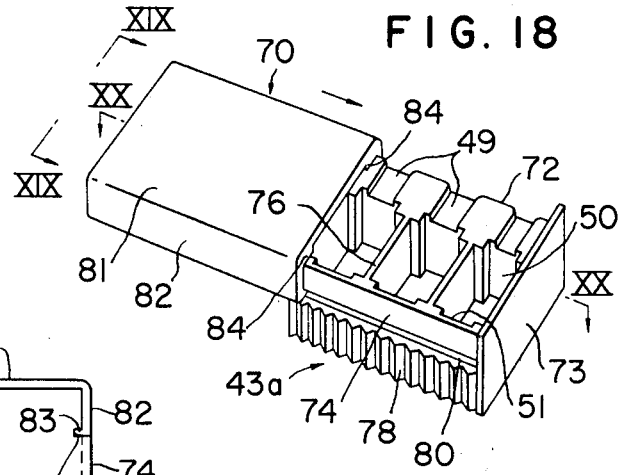
FIG. 18 is a perspective view of another cartridge box for use with the ink supply device according to the invention.
Figure 19:
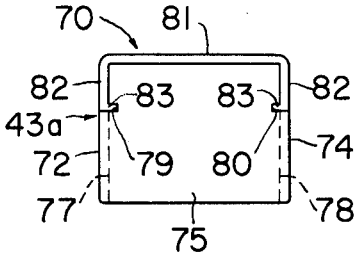
FIG. 19 is an end elevational view of the cartridge box as seen in the direction of the arrows XIX in FIG. 18.
Figure 20:
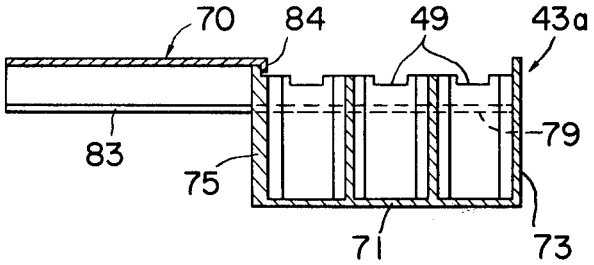
FIG. 20 is a sectional view of the cartridge box taken along the plane of line XX—XX in FIG. 18.

FIGS. 18, 19, and 20 illustrate another form of the cartridge box adapted to house a plurality of inking roller cartridges identical with that shown in FIGS. 10, and 11. The another cartridge box 43*a* is furnished with a sliding cover 70 so that the cartridges will not fall off when, for instance, the cartridge box is turned upside down.

As in the preceding example, the cartridge box 43*a* comprises a bottom wall 71 and side walls 72, 73, 74 and 75 and is open at the top. The side wall 72 is considerably thicker than the other side walls 73 to 75 or the bottom wall 71 and has the transverse guide channels 49 formed in its top surface in parallel spaced relationship. The recesses 50 and 51 are formed correspondingly in the opposed internal surfaces of the side walls 72 and 74, respectively, to neatly receive the U-shaped roller supports 34 of the respective inking roller cartridges 11.

Characteristic of the cartridge box 43*a* resides in a plurality of partitions 76 extending between the opposed side walls 72 and 74 to divide the interior of the cartridge box into several chambers each designed to accommodate a single inking roller cartridge. Furthermore, the external surfaces of the side walls 72 and 74 are knurled at their lower portions to afford a firm grip, as indicated by the numerals 77 and 78, and slots 79 and 80 are formed along the upper boundaries of the knurled portions 77 and 78, respectively. The remaining upper portions of the external surfaces of these side walls 72 and 74 are set inwardly with respect to the respective knurled lower portions 77 and 78.

The cover 70 is generally of inverted U-shaped cross section, comprising a top plate 81 and a pair of side plates 82. The side plates 82 terminate in inwardly directed guide flanges or rims 83. The cover 70 is thus adapted to be mounted astride the cartridge box 43*a*, with the guide flanges 83 of the former slidably fitted in the respective slots 79 and 80 of the latter. In order to permit the cover 70 to be retained in its open position shown in FIGS. 18 and 20 without falling off the cartridge box 43*a*, a pair of stops may be formed as at 84 on the cover. These stops are designed to abut against the cartridge box side wall 75 when the cover 70 is moved to its open position, and against the opposite wall 73 when the cover is slid back to its closed position as indicated by the arrow in FIG. 18.

Figure 21:
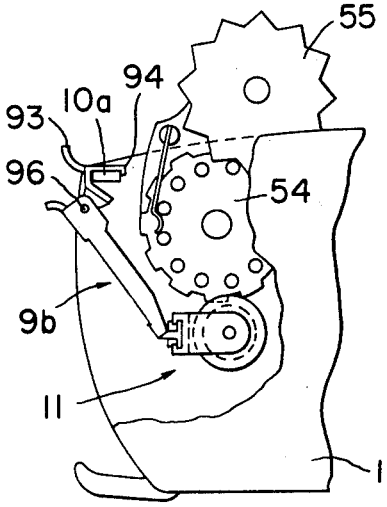
FIG. 21 is a view similar to FIG. 16, but showing the labeling machine incorporating still another preferred embodiment of the invention.
Figure 22:
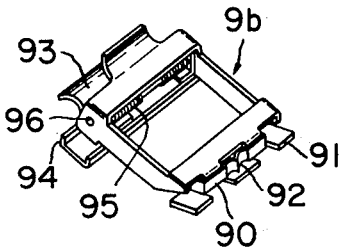
FIG. 22 is a perspective view of the cartridge holder shown in FIG. 21.
Figure 23:
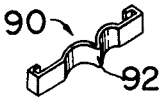
FIG. 23 is a perspective view of a leaf spring used in the cartridge holder shown in FIG. 22.

FIGS. 21, 22 and 23 illustrate another possible modification of the cartridge holder, which differs from the example shown in FIGS. 3 through 9, inclusive or in FIGS. 16 and 17 in that a leaf spring 90 is employed for holding the linking roller cartridge 11 in the correctly aligned position on the modified cartridge holder 9*b* by resiliently engaging in the indentation 41, FIG. 10, in the roller support 34 of the cartridge.

As best illustrated in FIG. 22, the leaf spring 90 is mounted adjacent a tenon 91 at the lower or free end of the cartridge holder 9*b*, the tenon being here provided in plate-like form. The leaf spring 90 is centrally crimped to provide a projecting portion 92 adapted to enter the identation 41 in the roller support 34 of the inking roller cartridge 11 when the tenon 91 is fully inserted into the mortise 42 in the latter.

At the other end of the cartridge holder 9*b* there is pivotally mounted a fingerhold tab 93 integrally comprising a pair of elongate gripping jaws 94. Unlike the preceding examples, these gripping jaws 94 are adapted to snugly but detachably fit over a beam 10*a* of rectangular cross section extending between the opposed side walls 1 of the labeling machine in place of the transverse pin 10, as will be seen from a consideration of FIG. 21. A torsion spring shown at 95 in FIG. 22 biases the cartridge holder 9*b* counterclockwise, as viewed in FIG. 21, about a pivot pin 96. Thus the inking roller 35 of the cartridge 11 mounted on the free end of the cartridge holder 9*b* is urged into circumferential contact with the printing drum 54 to ink the relief characters that are arranged in the mentioned printing positions on the underside of the drum.

Figure 24:
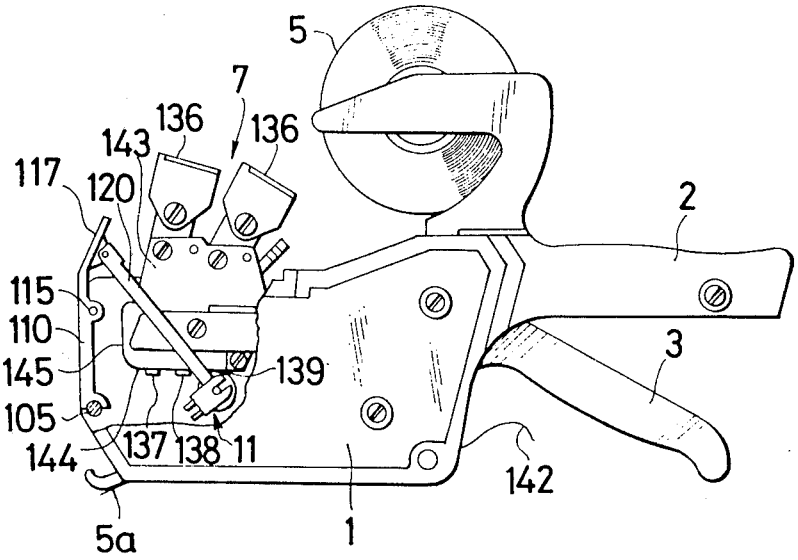
FIG. 24 is a partly cut, side elevational view of another labeling machine to which an ink supply device constituting a further effective embodiment of the invention is attached.
Figure 25:
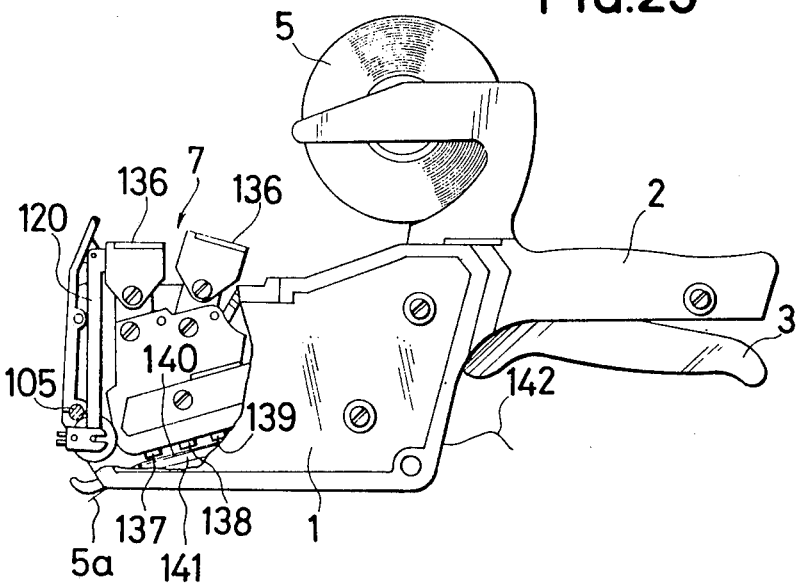
FIG. 25 is a similar view showing the labeling machine shown in FIG. 24 in actuated state.
Figure 26:
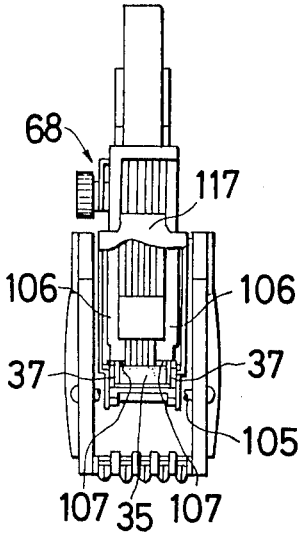
FIG. 26 is a front view of the machine shown in FIG. 24.

The ink supply device according to the present invention can be constructed so as to be adapted for use in other labeling machine as shown in FIGS. 24, 25 and 26, said machine comprising a roll of label tape 5 consisting of a backing strip 142 and a series of labels 140 adhered continuously on said backing strip, a palm-grip handle 2, a grip lever 3, confronting side walls 1 which form therebetween a space adapted for arranging therein a conventional printing mechanism 7 and a label feeding mechanism (not shown). Detailed description of the construction and operations of said printing mechanism and label feeding mechanism are omitted herewith because they are conventional and have no direct relation to the subject ink supply device of the present invention. In the labeling machine, the label tape 5 is advanced per unit label by squeezing and releasing the handle 2 and grip lever 3, and desired inscriptions are printed on said advanced unit label 5*a* at a type base 141 by the printing mechanism 7 and then the thus printed label is stripped off from the backing strip 142 so as to be dispensed out from the dispensing opening of the machine, said backing strip 142 stripped off being fed out rearward.

The ink supply device to be utilized in the labeling machine as mentioned above will be described in detail in connection with FIGS. 27 to 33, said ink supply device comprising an inking roller cartridge 11 and a cartridge holder 9*c* for attaching said inking roller cartridge to the labeling machine.

Referring to FIGS. 28 to 31, the inking roller cartridge 11 consists of an inking roller assembly 33 and a U-shaped roller support 34. The inking roller assembly 33 consists of an inking roller 35 made of cylindrical sponge or like elastic material which is uniformly impregnated with a suitable amount of ink and fixedly mounted on a hollow shaft 103 which is provided at its both ends with a pair of flanges (37, 37).

Figure 27:
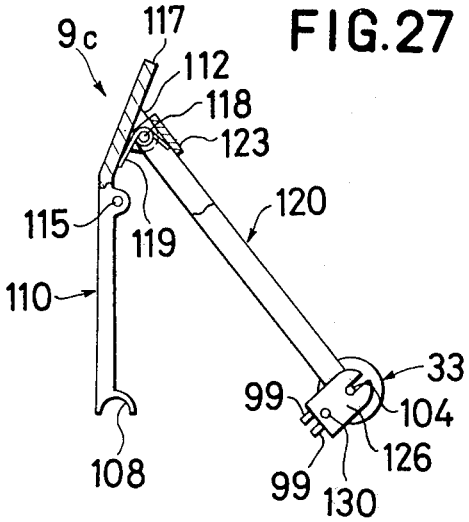
FIG. 27 is a side view of a cartridge holder included in the ink supply device used for the labeling machine shown in FIGS. 24 and 25.
Figure 32:
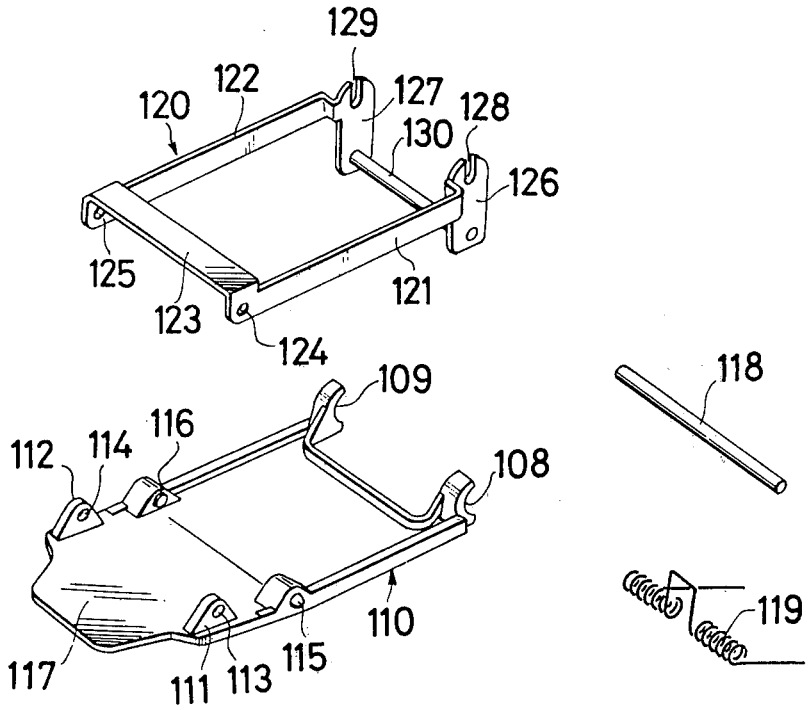
FIG. 32 is a perspective view of decomposed elements of the cartridge holder included in the ink supply device used for the labeling machine shown in FIGS. 24 and 25.

The U-shaped inking roller support 34 consists of right and left side plates (39, 39), a connecting member 97 which connects the lower parts of said side plates as one unit body, and a pivotal shaft 102 which is passed through the hollow shaft 103 of the inking roller assembly 33, supported by said side plates (39, 39) and projected out therefrom so as to form engaging parts (104, 104), said connecting member 97 being provided at its rear side with a longitudinal groove 100 and two pairs of legs (98, 98) and (99, 99) which are respectively projected downward from said connection member at the positions under said side plates (39, 39), said legs of each pair forming a forked shape so as to form a guide groove 101 therebetween. Width of the guide groove 101 is selected to be narrower than that of the groove 100. As shown in FIGS. 24, 27 and 32, the inking roller cartridge 11 is attached to the labeling machine by means of a cartridge holder 9*c* consisting of a plate-shaped attaching member 110, a holder 120, a pivot pin 118, and a spring 119. As particularly shown in FIG 24, the attaching member 110 can be detachably attached to a transversal support rod 105 which in turn is supported by the recesses provided inside of the side walls 1 of the labeling machine, whereby the cartridge holder can be attached to the machine itself.

For causing detachable attachment of the attaching member 110 to the transversal support rod 105, the attaching member 110 is provided at its lower part with semicircular support recesses 108 and 109 adapted for gripping the support rod 105, at its upper part with a knob part 117, at the position near said knob part with bearing members 111 and 112 having respectively bearing holes 113, 114, and at the positions between the bearing members (111, 112) and the support recesses (108, 109) with engaging members 115, 116 having spherical heads which are always projected outward by means of a spring not shown.

The holder 120 forms a rectangular frame and consists of parallelly arranged intermediate arms (121, 122), a connecting piece 123 provided so as to connect end parts of said arms 121, 122 at one side thereof, holding pieces 126 and 127 provided at inwardly bent other end parts of said arms, and support pin 130 which connects said holding pieces 126 and 127, said members 121, 122, 123, 126 and 127 being unified as one body and diameter of said support pin 130 being made to be smaller than the width of the groove 100.

Figure 28:
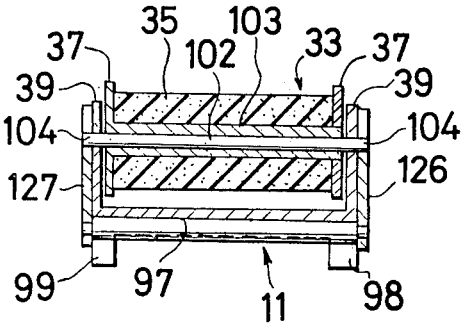
FIG. 28 is a axial sectional view of the inking roller cartridge included in the ink supply device used for the labeling machine shown in FIGS. 24 and 25.
Figure 29:
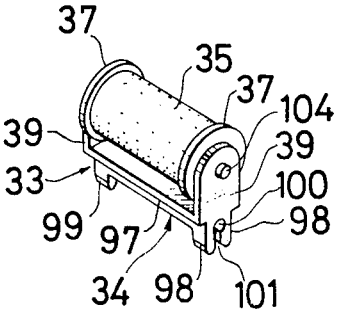
FIG. 29 is a perspective view of the inking roller cartridge shown in FIG. 28.
Figure 30:
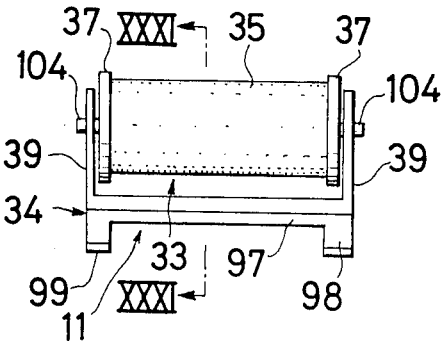
FIG. 30 is a side elevational view of the inking roller cartridge shown in FIGS. 28 and 29.
Figure 31:
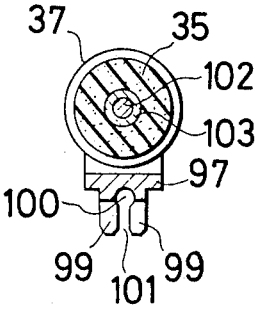
FIG. 31 is a sectional front view of the inking roller cartridge shown and sectional along the plane XXXI—XXXI in FIG. 30.

The arms 121 and 122 are respectively provided with holes 124 and 125 at the under parts of the connecting piece 123, and the holding pieces 126 and 127 are respectively provided with cut slot 128 and 129. The distance between the holding pieces 126 and 127 is made to be wider than the distance between the side plates (39, 39) of the U-shaped inking roller support 34, and therefore as shown in FIG. 28, said side plates 39, 39 of the U-shaped roller support 34 can be engaged between the holding pieces 126 and 127 so as to make the cut slots 128 and 129 of the pieces 126 and 127 engage with the engaging parts 104, 104 of the pivotal shaft 102 of the U-shaped inking roller support 34.

The attaching member 110 and the holder 120 are assembled, as shown in FIG. 27, by setting the holes 113 and 114 of the attaching member 110 in the position coincident with the holes 124 and 125 of the holder 120 and then by inserting pivot pin 118 through said holes while setting the spring 119 between the holes 124 and 125 so that the attaching member 110 and the holder 120 are turned relatively away from each other about the pivot pin 118.

Figure 33:
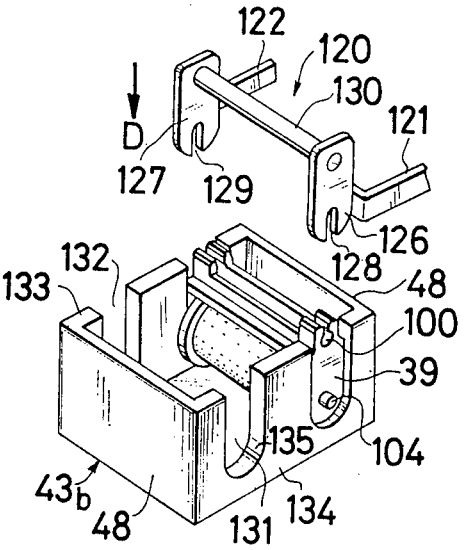
FIG. 33 is a perspective view of a part of holder for holding the inking roller cartridge and that of a cartridge box.

In FIG. 33 is shown a cartridge box 43*b* for enclosing therein the inking roller cartridge 11, said box being provided with a bottom plate 131 and side walls 48, 48, 133 and 134. Confronting cut recesses 132 and 135 of plural pairs are respectively provided in the side walls 133 and 134, said recess being adapted for supporting the U-shaped inking roller support 34. The distance between outside surfaces of the side walls 133 and 134 is made to be equal to or somewhat short than the distance between the outside heads of the engaging parts (104, 104) of the pivotal shaft 102 of the U-shaped inking roller support 34.

Furthermore, for the purpose of transportation or preservation of the cartridge box 43*b*, it is preferable to provide a suitable conver or sack of the box, thereby to protect the inking roller cartridge 11 from dropping-off thereof. Assemblying of the inking roller cartridge 11 with the holder 120 of the cartridge holder 90.

As shown in FIG. 33, when the holder 120 is lowered toward the direction (D) so as to push the holding pieces 126 and 127 along the cut recesses 132 and 135 of the cartridge box 43*b* thereby to make the cut slots 128 and 129 of the holding pieces 126 and 127 engage with the engaging parts (104, 104) of the pivotal shaft 102 of the U-shaped inking roller support 34, and then the support pin 130 is inserted into the groove 100 while extending the guide groove 101 formed between each pair of the legs (98, 98) and (99, 99) said support pin 130 is securely engaged with said grooves 110, thus causing possibility of handling the holder 120, box 43*b* and inking roller cartridge 11 as one unit.

On the other hand, when the legs (98, 98), (99, 99) of the cartridge 11 of the state as shown in FIG. 28 is put on a suitable board and the holding pieces 126 and 127 are pressed down by handling the arms 121 and 122, the cut slots 128 and 129 are detached from the engaging parts (104, 104) of the pivotal shaft 102 and the support pin 130 is detached from the groove 100, whereby the inking roller cartridge 11 can be easily detached from the holder 120. Attachment of the inking roller cartridge 11 to the labelling machine and printing operation thereof.

Firstly, by pinching the knob part 117 of the attaching member 110, the support frames (143, 143) of the printing mechanism 7 having typing means (136, 136) are put between the arms 121 and 122 of the holder 120 and the inking roller cartridge 11 held by the holder 120 is put under the types (137, 138, 139) of said typing means, as shown in FIGS. 24 and 26, and then the support recesses (108, 109) and the engaging members (115, 116) of the attaching member 110 are respectively engaged with the support rod 105 and the inside recesses provided in the side walls 1 of the labeling machine, whereby the holder 120 is attached to the labelling machine. In this state, the upper surface of the inking roller 35 is in contact with the type 139 thereby to supply a suitable amount of ink onto said type 139. Then, when the palm-grip handle 2 and the grip lever 3 are strongly gripped, the types (137, 138, 139) are lowered as shown in FIG. 25, so that printing on a unit label of the label tape is carried out.

During one printing operation as mentioned above, the under edge 144 and the front edge 145 of the frames (143, 143) are lowered while being contacted with the flanges (37, 37) of the inking roller 35, so that the inking roller 35 is rotated during said one printing operation, whereby the holder 120 is rotated clockwise about the pivot pin 118.

On the other hand, upon release of the palm-grip handle 2 and the grip lever 3, the printing mechanism is restored to the states as shown in FIG. 24, and simultaneously the holder 120 also is restored to the state shown in FIG. 24 by the action of the spring 119 and waits the next ink supply. By repetition of the above operations, the printing is repeated.

According to the embodiment as illustrated in FIGS. 24 to 33; besides the main advantage such that exchange of the inking roller assembly can be easily attained without causing contamination of fingers on clothes, there is further advantages such that detachable attachment of the inking roller cartridge to the cartridge holder and attachment of said holder to the labeling machine are effectively insured, and that since the arms 121 and 122 of the holder 120 are considerably spaced so that the printing device can be arranged therebetween so as to make large the turn angle of the holder 120, even when plural typing means are provided in the traveling direction of the inking roller, it becomes possible to carry out stable ink supply onto the types of all typing means by using one inking roller assembly.

Although the ink supply apparatus according to the invention has been shown and described hereinbefore in very specific aspects thereof, it is to be understood that the invention itself is not to be restricted by the exact showing of the accompanying drawings or the description thereof. For example, while the cartridge holder is provided with the tenon, and the inking roller cartridge with the mortise, in the examples disclosed herein, it is of course possible to provide the cartridge holder with the mortise and the cartridge with the tenon. This and other modifications or changes within the usual knowledge of the specialists are considered to be comprehended within the scope of the invention.

I claim:

1. In an ink supply device for supplying ink onto a type surface of a printing mechanism of a labeling machine, said printing mechanism being used for printing inscriptions on each of a series of labels fed by indexed movement along a travel path thereof within the machine and said ink supply device comprising holding means adapted for supporting and attaching the device onto the machine; said ink supply device comprising an inking roller cartridge having at least one inking roller and a U-shaped inking roller support for supporting said inking roller, said U-shaped inking roller support having engaging means, said holding means comprising a cartridge holder adapted for holding said inking roller cartridge, said cartridge holder having a first part adapted to be detachably engaged with a part of the labeling machine and with a second part adapted to be detachably engaged with said former engaging means of said U-shaped inking roller support to support thereby said inking roller cartridge, the inking roller cartridge comprising a U-shaped inking roller support having a pair of side plates which are confronted with each other, at least one pivotal shaft supported by said side plates so as to be projected outward therefrom, and an inking roller supported by said pivotal shaft, said U-shaped inking roller support being provided with a fixing means; and the cartridge holder comprises a holder and an attaching member, said holder comprising a pair of arms which are spaced for a predetermined distance, supporting means which comprise a pair of holding pieces unified with one side ends of said arms and having cut slots adapted to be engaged with the pivotal shaft of said U-shaped inking roller support, and a support pin adapted to be engaged with said fixing means of said U-shaped inking roller support, said attaching member being attached to other side ends of said arms and comprising support means for attaching the attaching member itself to the labeling machine thereby to attach said holder with the inking roller support to the labeling machine.

2. The ink supply device as claimed in claim 1, wherein the fixing means of said inking roller support consists of elastic U-shaped groove means.

3. The ink supply device as claimed in claim 1, wherein the confronting distance between the arms of a pair is made to be larger than the width of at least one part of the printing mechanism of the labeling machine.

4. The ink supply device as claimed in claim 1, wherein the attaching member of the cartridge holder comprises support means connected pivotally to the holder and adapted to be detachably attached to the labeling machine and a spring member for urging the inking roller supported by the U-shaped inking roller support onto the types provided in the printing mechanism when said support means is attached to the labeling machine.

5. The ink supply device as claimed in claim 4, wherein said support means comprises members projected from both sides thereof, said members having shapes adapted to be engaged with slots formed inside of the frames of the labeling machine, and comprises at least one support recess provided on one end part of the support means and adapted to be engaged with a transversal support rod supported by frames of the labeling machine.

* * * * *